US006332243B1

(12) United States Patent
Kim

(10) Patent No.: US 6,332,243 B1
(45) Date of Patent: Dec. 25, 2001

(54) VEHICLE DOOR PROP BUTTON

(75) Inventor: Felix Sung Hoon Kim, Toronto (CA)

(73) Assignee: Multimatic Inc., Ontario (CA)

( * ) Notice: Subject to any disclaimer, the term of this patent is extended or adjusted under 35 U.S.C. 154(b) by 0 days.

(21) Appl. No.: 09/466,880

(22) Filed: Dec. 20, 1999

Related U.S. Application Data

(60) Provisional application No. 60/113,178, filed on Dec. 21, 1998.

(51) Int. Cl.[7] ..... E05D 11/10

(52) U.S. Cl. ..... 16/334; 16/374; 16/82

(58) Field of Search ..... 16/334, 332, 82, 16/374

(56) References Cited

U.S. PATENT DOCUMENTS

| | | | | |
|---|---|---|---|---|
| 1,445,681 | | 2/1923 | Hage . | |
| 1,884,827 | | 10/1932 | Perry . | |
| 1,884,828 | | 10/1932 | Perry . | |
| 1,884,832 | | 10/1932 | Perry . | |
| 1,991,517 | | 2/1935 | Perry . | |
| 3,577,840 | * | 5/1971 | Buberniak | 16/332 X |
| 3,758,141 | | 9/1973 | Weinberger . | |
| 4,672,715 | * | 6/1987 | Beckwith | 16/334 |
| 4,794,669 | * | 1/1989 | Sanders | 16/334 X |
| 5,027,471 | | 7/1991 | Barnes . | |
| 5,074,010 | * | 12/1991 | Gignac et al. | 16/334 |
| 5,218,738 | * | 6/1993 | Krajenke | 16/334 |
| 5,323,512 | * | 6/1994 | Little | 16/332 |
| 5,346,272 | | 9/1994 | Priest et al. . | |
| 5,511,837 | | 4/1996 | Dempsey et al. . | |
| 5,560,080 | | 10/1996 | Reed . | |
| 5,675,865 | | 10/1997 | van der Stuer . | |
| 5,692,264 | | 12/1997 | van der Steur . | |
| 5,924,170 | * | 7/1999 | Papke et al. | 16/82 X |
| 5,926,917 | * | 7/1999 | Gantz | 16/334 |
| 6,108,866 | * | 8/2000 | Waynick, Jr. | 16/82 |
| 6,148,481 | * | 11/2000 | Chen | 16/334 |

* cited by examiner

*Primary Examiner*—Lynne H. Browne
*Assistant Examiner*—David E. Bochna
(74) *Attorney, Agent, or Firm*—Borden Ladner Garvais; Terry Kramer

(57) ABSTRACT

A temporary vehicle door check mechanism suitable for use during vehicle painting operations comprises a hinge comprising door side and body side portions, and an intermediate bridge portion, all of which are rotatably connected at a common axis of rotation. A flexible prop button is mounted to either the door side or the body side portions of the hinge, and is adapted to releasably contact the intermediate bridge portion of the hinge as the door is rotated about the hinge, to releasably hold the door in a partially or fully open position.

8 Claims, 6 Drawing Sheets

VEHICLE DOOR PROP BUTTON

This applications claims benefit to 60/113,178 filed Dec. 21, 1998.

FIELD OF INVENTION

This invention relates to a button for positioning and holding a vehicle door in an open position.

BACKGROUND OF INVENTION

Generally, in the process of manufacturing a vehicle, the vehicle body and doors are painted simultaneously. This is required to ensure color match between the body and the doors, which could not otherwise be guaranteed if the doors were painted separately. In this manner, the door assemblies are fitted onto the door hinges and positioned in proper vehicle orientation. Subsequently, during the painting process, the door assemblies are repeatedly opened and closed to permit access to all of the surfaces to be painted by the painting equipment. During some of these operations, the vehicle doors must be positioned and retained in the open position. Alternately, other operations require that the vehicle doors be positioned and retained in the closed position. Accordingly, the door assemblies must be equipped with means for releasably positioning and retaining the doors in the open or closed position.

Heretofore, difficulties have been encountered in equipping the door assemblies with a suitable detent mechanism, especially those with separate checks. More particularly, due to the overspray of the paint and other adverse environmental conditions, the production check strap assemblies cannot be utilized. Accordingly, temporary check strap fixtures have been utilized. More particularly, a multiple piece check strap assembly is secured to the door assembly and operably coupled to the vehicle body. The temporary check strap fixture provides a detent for the door assembly between an open and closed position. Upon completion of the painting process, the temporary check strap fixture is uncoupled from the body, the door assemblies are removed from the vehicle body and then the temporary check strap fixture is removed from the door assembly. Since each temporary check strap fixture is fairly costly, they are reconditioned by removing excess paint from the fixture and recycled for use again on other vehicle bodies. Thus, these temporary check strap fixtures are costly in design, in installation, and in maintenance Additionally, detent mechanisms have been proposed for particular types of hinges which requires the mechanism to be screwed or fastened to the hinge which has a removable hinge pin as illustrated in U.S. Pat. No. 5,577,295, entitled "Three Diameter Hinge Pin". The screw on type detent mechanism adds considerable cost to the door painting process due to fastener cost and additional labor costs for drilling and tapping a receiving hole in the bracket body and the cost of removal. The use of the screw on type mechanism is thus limited to applications which employ this particular hinge.

SUMMARY OF THE INVENTION

The disadvantages of the prior art may be overcome by providing a vehicle door prop button which is easily installed without a fastener and is easily removed.

In a major aspect, the invention comprises a temporary vehicle door checking mechanism comprising a hinge comprising door side and body side portions and an intermediate bridge portion, the intermediate bridge portion of the hinge being rotatably connected to the door side and body side portions of the hinge at a common axis of rotation: a flexible prop button mounted to one of the door side or body side portions of the hinge and adapted to releasably contact the intermediate bridge portion of the hinge as the door is rotated about the hinge from a closed position to an open position, said contact compressing the button and generating sufficient frictional resistance to releasably hold the door in a partially or fully open position.

In a further aspect of the invention, the intermediate bridge portion of the hinge comprises a concave arcuate surface between first and second convex lobes adapted, as the door is rotated, to sequentially contact the prop button to compress it against the first convex lobe, release the prop button to lie adjacent the concave arcuate surface between the first and second convex lobes, and then to compress the prop button against the second convex lobe.

In a further aspect of the invention, the prop button extends inwardly of the hinge to minimize unwanted extraneous impediments to painting of the vehicle.

In a further aspect, the prop button is easily removable following painting of the vehicle.

In a further aspect, the body side portion of the hinge comprises formed protrusions comprising rotational stop limits for the intermediate bridge portion.

In a further aspect of the invention, the prop button comprises a stem portion and a hollow cap portion.

In a further aspect of the invention, the prop button comprises a flexible thermoplastic material which may be reinforced nylon resin.

DESCRIPTION OF THE DRAWINGS

In drawings which illustrate the preferred embodiment of the present invention.

DESCRIPTION OF THE INVENTION

Figure 1:
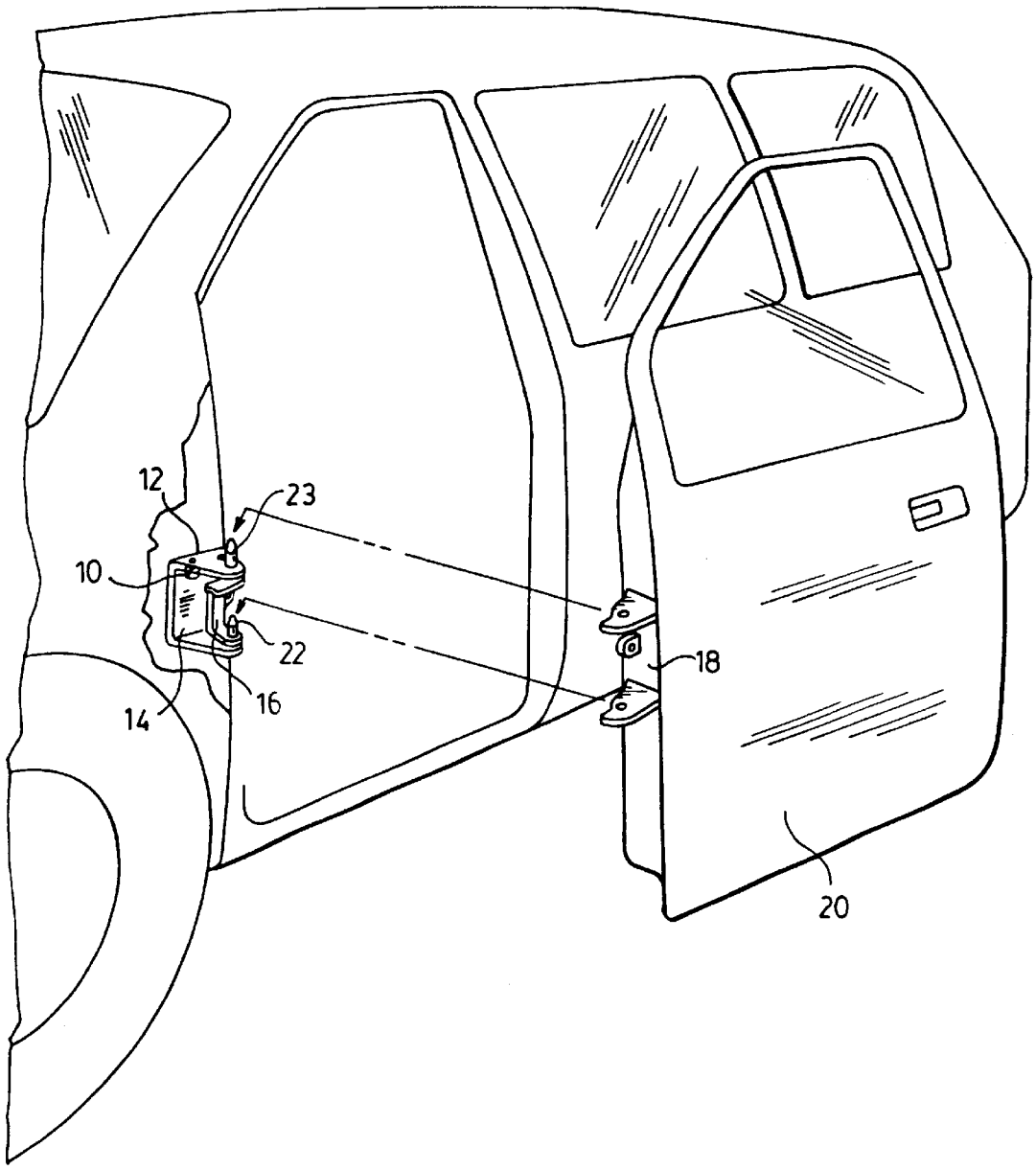
FIG. 1 is a perspective view of a vehicle incorporating a door hinge with a door prop button of the present invention.
Figure 2:
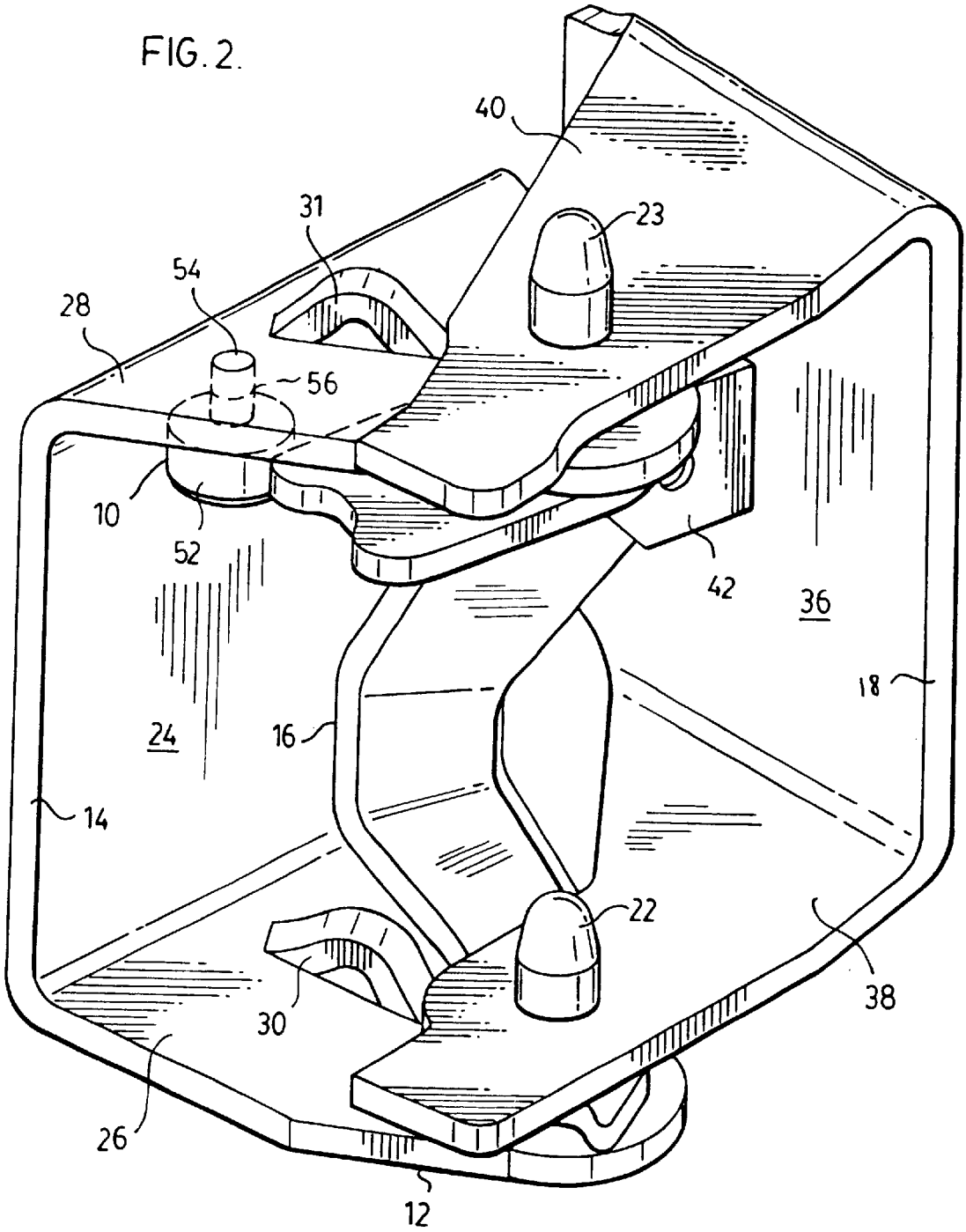
FIG. 2 is a perspective view of a door hinge and prop button of FIG. 1.

Referring to FIGS. 1 and 2, there is illustrated a prop button 10 mounted on a door hinge 12. Door hinge 12 comprises a body bracket 14 and a U-shaped bridge 16 secured to the vehicle and a door bracket 18 secured by bolts to a vehicle door 20. Door bracket 18 is pivotally mounted onto pins 22 and 23 of body bracket 14.

Door hinge 12 is conventional in design and manufacture. Such hinges can be found on a CHEVROLET SILVERADO.

Figure 3:
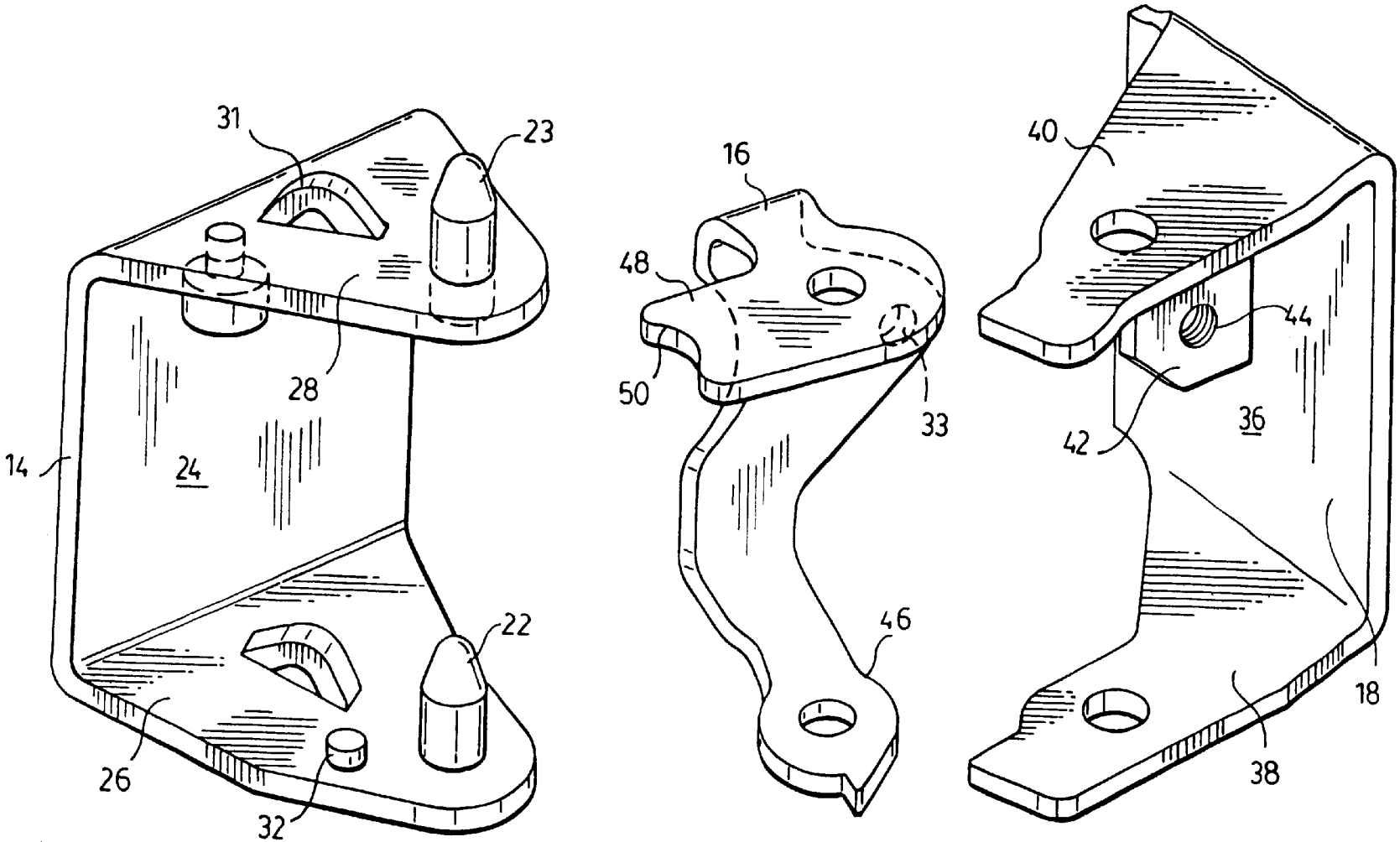
FIG. 3 is an exploded view of the door hinge and prop button of FIG. 1.

Referring to FIGS. 2 and 3, body bracket 14 is generally U-shaped having a bight portion 24 and two legs 26, 28 extending therefrom. Legs 26, 28, each have an aperture for mounting pins 22, 23, respectively. Pins 22, 23 extend upwardly. Legs 26, 28 each have a formed dimple 30, 31, respectively presenting a stop limit for U-shaped bridge 16. Leg 26 has a pin 32 also presenting a stop limit at the opposite extent of the swing of hinge 12. Body bracket 14 is welded onto the vehicle frame in a manner well known in the art.

Hinge 12 has a U-shaped bridge 16 having legs 46 and 48 extending therefrom. The distal end of leg 48 has an arcuate surface 50 Bridge 16 is configured to fit between legs 26 and 28 and is coaxially mounted on pins 23, 22. Bridge 16 has an aperture 33 for receiving a bolt 34.

Door bracket 18 is generally U-shaped having a bight portion 36 and two legs 38, 40 extending therefrom. Legs 38, 40 are configured to be pivotally mounted over top of pins 22, 23 and have apertures for receiving the pins 22, 23. The distal ends of the legs 38 and 40 are configured to abut with the stops 32 and 31, respectively The bight portion 36 has a tab 42 having a threaded through bore 44. Threaded bore 44 receives bolt 34 through the link 16 after the door bracket 18 has been mounted on the pins 22, 23 to retain the door 20 on the vehicle. Door bracket 18 is welded onto the vehicle door 20 in a manner well known in the art.

Figure 8:
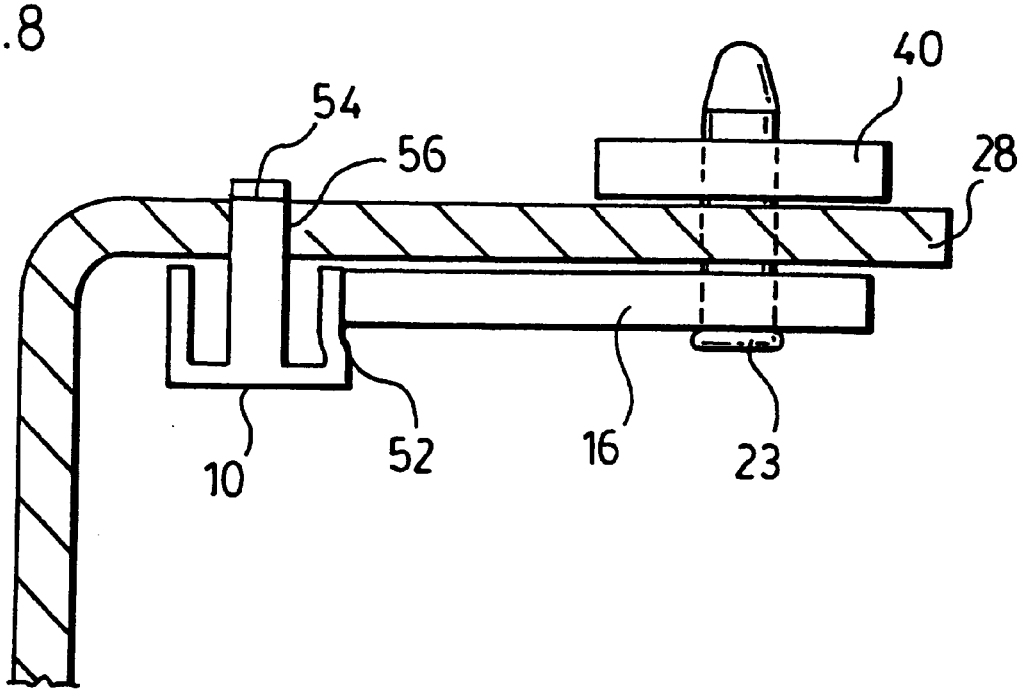
FIG. 8 is a top plan view of the door hinge of FIG. 4 in a painting position.

As illustrated in FIG. 8, the door prop button 10 is generally mushroom shaped having a hollow cap 52 and a stem 54. Leg 28 has a through bore 56 for receiving the stem 54 of the prop button 10. The cap 52 extends downwardly on the under surface of leg 28. The radial distance between the position of the cap 52 and the rotation of the link 16 is selected for engagement therebetween in an interference relation. Preferably, the prop button 10 is made from a mineral reinforced nylon resin, having flex modulus of about 5100 MPa.

Figure 4:
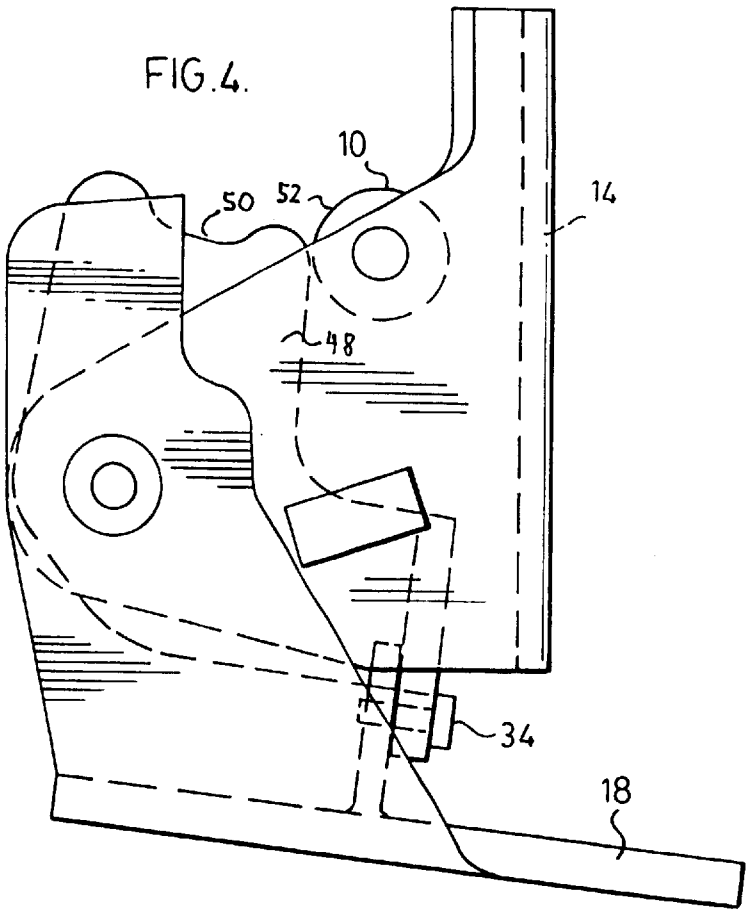
FIG. 4 is a top plan view of a door hinge in a closed condition.

Referring to FIG. 4 and FIG. 8, the door prop button 10 is mounted on the hinge 12 in the door closed portion. The door prop button 10 is frictionally inserted into bore 56 and held in place by a ring clip (not shown). The cap 52 is on the underside of leg 28 in order to minimize the coverage and visibility of the button 10 for painting purposes. The prop button 10 will hold the door 20 in a closed position.

As the door 20 and the door bracket 18 is opened, the distal end of leg 48 frictionally engages the cap 52. Some effort is required to overcome the compressive and frictional forces generated by the button 10.

Figure 5:
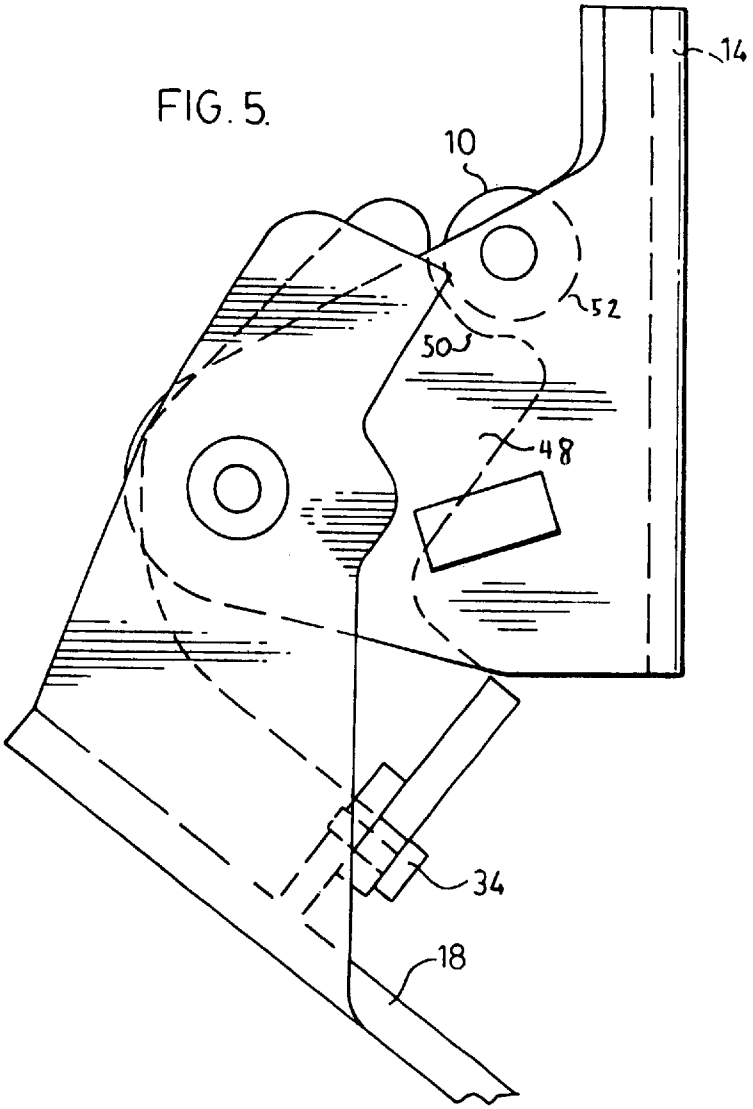
FIG. 5 is a top plan view of the door hinge of FIG. 4 in an opening condition.
Figure 6:
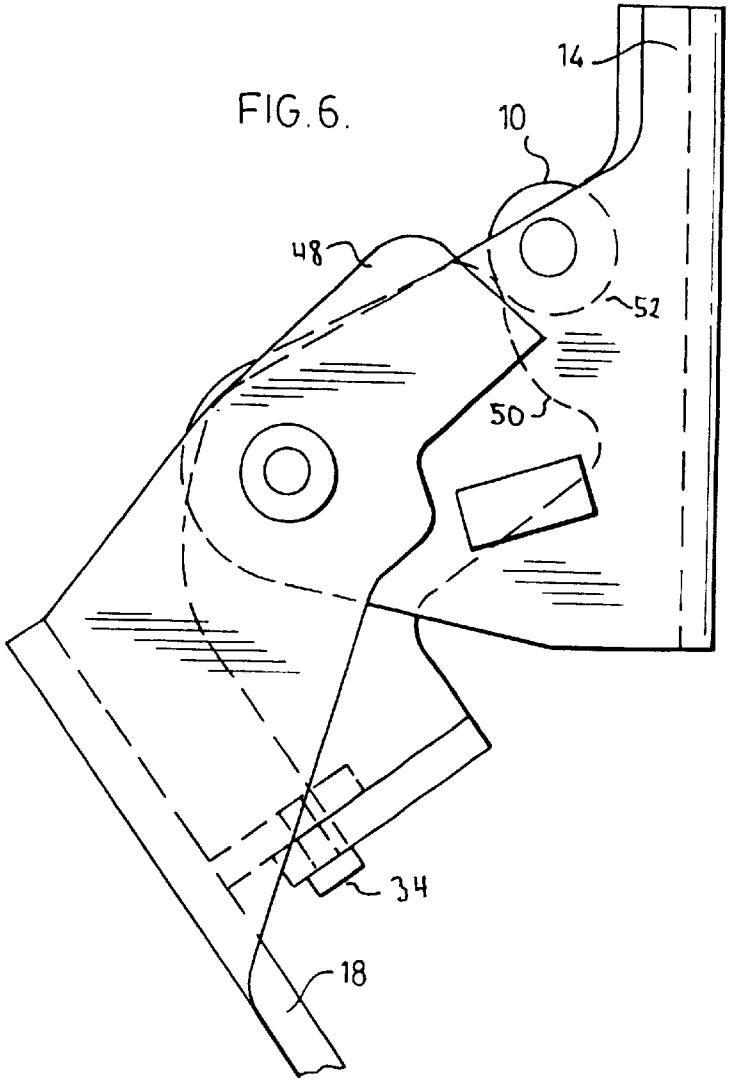
FIG. 6 is a top plan view of the door hinge of FIG. 4 in a mid-open position.

As the door is further opened to the mid-open position (FIG. 5), the distal end of leg 48 has moved partially across the cap 52 which now is nested in the arcuate surface 50 to maintain the door 20 in the mid-open condition. As the door is further opened (FIG. 6), the distal end of leg 48 again engages the cap 52 requiring effort to overcome the compressive and frictional forces generated.

Figure 7:
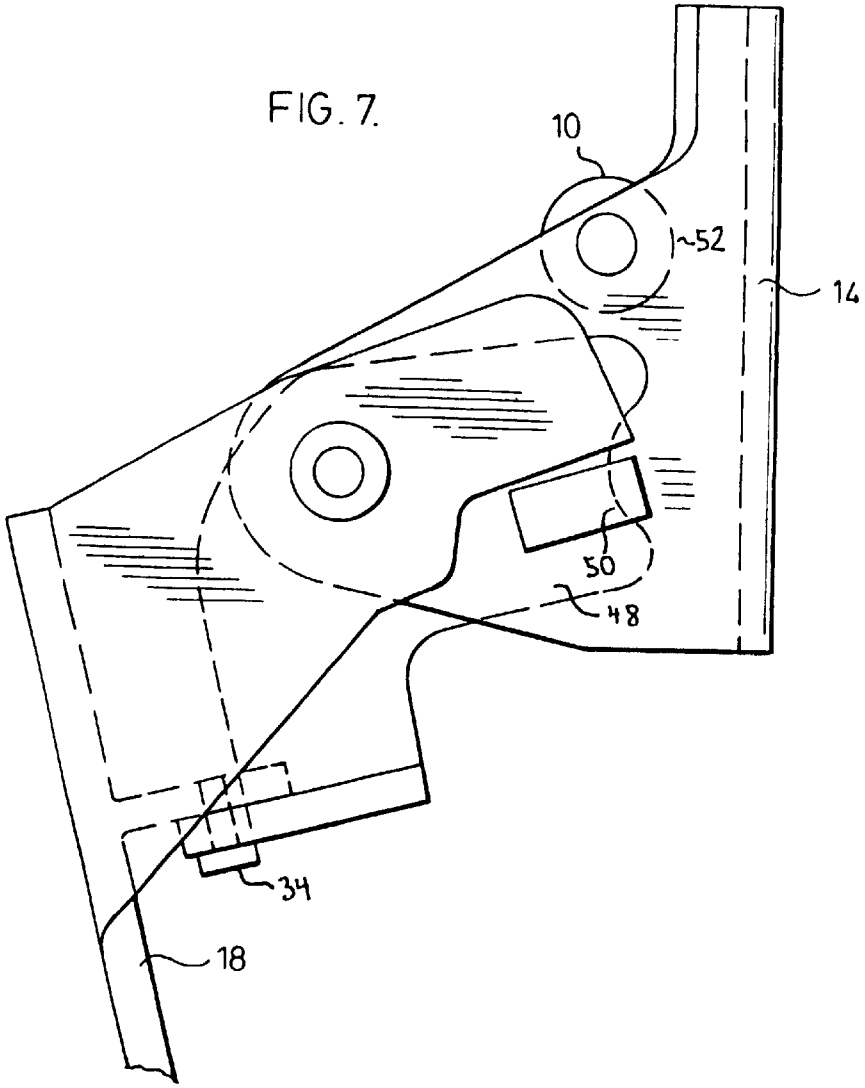
FIG. 7 is a top plan view of the door hinge of FIG. 4 in a full open position.

As the door is fully opened (FIG. 7), the cap 52 is no longer compressed but abuts leg 48 which holds the door in a full open condition and which also allows easy removal of the button 10.

FIG. 8 illustrates the door when slightly closed to compress cap 52. The compression and frictional forces generated by the cap 52 will restrict the door from moving once in the desired position.

While the present invention has been described in reference to a particular embodiment, one skilled in the art can recognize that certain modifications could be made without departing from the scope of the present invention. For example, the prop button could be mounted on the body side of the hinge and the parts appropriately configured to create the same effects. Additionally, the shape of the prop button could be varied to create the same effects.

What is claimed is:

1. A temporary vehicle door checking mechanism comprising:

(a) a hinge comprising door side and body side portions and an intermediate bridge portion, (b) the intermediate bridge portion of the hinge being rotatably connected to the door side and body side portions of the hinge at a common axis of rotation;

(c) a flexible prop button mounted to one of the door side on body side portions of the hinge and adapted to releasably contact the intermediate bridge portion of the hinge as the door is rotated about the hinge from a closed position to an open position, said contact compressing the button and generating sufficient frictional resistance to releasably hold the door in a partially or fully open position.

2. The temporary vehicle door checking mechanism of claim 1, wherein the intermediate bridge portion of the hinge comprises a concave arcuate surface between first and second convex lobes adapted, as the door is rotated, to sequentially contact the prop button to compress it against the first convex lobe, release the prop button to lie adjacent the concave arcuate surface between the first and second convex lobes, and then to compress the prop button against the second convex lobe.

3. The temporary vehicle door checking mechanism of claim 1 or 2, wherein the prop button extends inwardly of the hinge to minimize unwanted extraneous impediments to painting of the vehicle.

4. The temporary vehicle door checking mechanism of claim 1 or 2, wherein the prop button is easily removable following painting of the vehicle.

5. The temporary vehicle door checking mechanism of claim 1 or 2, wherein the body side portion of the hinge comprises formed protrusions comprising rotational stop limits for the intermediate bridge portion.

6. The temporary vehicle door checking mechanism of claim 1, wherein the prop button comprises a stem portion and a hollow cap portion.

7. The temporary vehicle door checking mechanism of claim 1, wherein the prop button comprises a flexible thermoplastic material.

8. The temporary vehicle door checking mechanism of claim 1, wherein the prop button comprises a mineral reinforced nylon resin.

* * * * *

UNITED STATES PATENT AND TRADEMARK OFFICE

CERTIFICATE OF CORRECTION

PATENT NO. : 6,332,243 B1
DATED : December 25, 2001
INVENTOR(S) : Felix Sung Hoon Kim It is certified that error appears in the above-identified patent and that said Letters Patent is hereby corrected as shown below:

Column 4,
Line 23, delete the word "on" and insert -- or --.

Signed and Sealed this

Third Day of September, 2002

*Attest:*

*Attesting Officer*

JAMES E. ROGAN
*Director of the United States Patent and Trademark Office*